US005309804A

United States Patent [19]

Norris et al.

[11] Patent Number: 5,309,804

[45] Date of Patent: May 10, 1994

[54] ROTARY CUTTING APPARATUS AND METHOD FOR CUTTING NEWSPAPERS OR THE LIKE

[75] Inventors: James H. Norris, Huntington; Thomas M. Cunningham, West Islip, both of N.Y.

[73] Assignee: Newsday, Inc., Melville, N.Y.

[21] Appl. No.: 849,524

[22] Filed: Mar. 11, 1992

[51] Int. Cl.[5] ..... B26D 1/62

[52] U.S. Cl. ..... 83/37; 83/29; 83/117; 83/347; 83/673

[58] Field of Search ..... 83/29, 37, 117, 347, 83/673, 674, 346

[56] References Cited

U.S. PATENT DOCUMENTS

| | | | |
|---|---|---|---|
| 168,011 | 9/1875 | Fry | 83/117 |
| 947,100 | 1/1910 | Fuller | 83/674 |
| 1,274,623 | 8/1918 | Spiegel . | |
| 1,678,896 | 7/1928 | Wood . | |
| 1,797,278 | 3/1931 | Weis et al. . | |
| 1,986,139 | 1/1935 | Cumfer . | |
| 2,518,960 | 8/1950 | Tollison et al. | 83/117 |
| 3,088,640 | 5/1963 | Kunsch . | |
| 3,222,966 | 12/1965 | Tornberg et al. . | |
| 3,521,514 | 7/1970 | Fiezell . | |
| 3,555,948 | 1/1971 | Olson . | |
| 3,686,988 | 8/1972 | Ross . | |
| 3,768,801 | 10/1973 | Maynard et al. . | |
| 3,792,637 | 2/1974 | Saunders . | |
| 3,921,481 | 11/1975 | Marcus | 83/117 |
| 4,184,619 | 1/1980 | Stewart et al. . | |
| 4,228,735 | 10/1980 | Doucet . | |
| 5,123,316 | 6/1992 | Niedermaier et al. | 83/29 |

FOREIGN PATENT DOCUMENTS

| | | | |
|---|---|---|---|
| 172158 | 12/1921 | United Kingdom | 83/673 |

*Primary Examiner*—Hien H. Phan

*Attorney, Agent, or Firm*—Dilworth & Barrese

[57] ABSTRACT

A rotary cutter is disclosed for repeatedly cutting web printed sheet material with a printed repeat portion of finite length thereon which includes a cutting cylinder adapted for rotation in a manner such that the web printed sheet material passes thereby A cutting knife extends generally along the length of the cylinder on the outer surface for periodic engagement with a backup support cylinder for cutting the sheet material when positioned therebetween. The cutting knife is generally continuous along a major portion of the length thereof and has a minor arcuate portion which is discontinuous with the major portion so as to cut the sheet material whereby the sheet material on one side of the cutting line is provided with a straight cut portion having an arcuate projection extending therefrom and the sheet material on the other side of the cutting line is provided with a void portion corresponding in configuration and dimension to the arcuate projection. A method for cutting such newspapers is also disclosed.

21 Claims, 3 Drawing Sheets

ROTARY CUTTING APPARATUS AND METHOD FOR CUTTING NEWSPAPERS OR THE LIKE

BACKGROUND OF THE INVENTION

1. Field of the Invention

The present invention relates to a rotary cutting device of the type generally utilized for cutting newspapers, particularly tabloid newspapers, whereby a pair of rotary cylinders are rotated in opposite directions to cut stacked sheets bearing printed matter so as to form the individual newspapers. The invention also relates to the method for cutting newspapers and the newspaper unique product resulting therefrom.

2. Description of the Prior Art

In typical folding and cutting systems as applied to newspapers, the sheets of paper bearing printed matter in repeating fashion thereon are generally collated and stacked for passage through a pair of cutting rollers. Of the cutting rollers one of the rollers is provided with a cutting blade surrounded by a pair of cheekwoods in the form of spring biased wood strips which protect the cutting edge of the blade, but withdraw under pressure of the second roller. The second roller is provided with a plurality of backing strips generally of an elastomeric material, for supporting the cutting blade and the newspapers when the cutting process takes place. The rollers rotate in opposite directions and are of differing diameters; however, alternatively they may be of the same diameter.

The diameter of the cutting roller is selected such that one half the rotation of the roller represents the total width of the newspaper, in the present instance, the width of a tabloid-type newspaper. Thus, when two cuts are provided by one full revolution of the rollers, the space between the cuts represents the width of the tabloid newspaper.

Generally, each cutting blade is a straight metal serrated blade which provides a similarly serrated edge on the newspaper. The serrated edge is well known to consumers who are familiar with such publications.

More recently, the practice in the newspaper industry is to provide weekend or Sunday editions having several sections each of which covers a distinct topic. For example such sections are generally categorized as the main section, the sports section, the real estate section, etc. The newspapers are generally sold to consumers with all of the sections combined such that consumers have found it increasingly difficult to identify one section from another, thus making the separation process somewhat confusing. Accordingly, the need for providing means for identifying one section from another has been established.

In the past, attempts have been made to cut newspapers in a manner to identify one section from another. For example, one previous attempt utilized a cutting blade which was shaped to cut and remove an arcuate-shaped section from one edge of the newspaper, thus providing a void along the edge similar to the thumb-shaped cut-outs used to identify pages of certain reference books such as dictionaries. Although this system was somewhat successful in assisting consumers in identifying the individual newspaper sections, it introduced additional complications by requiring the removal of the arcuate shaped sections cut from the newspaper edges. When total removal of the cutout sections was not accomplished these sections remained in the cutting area and interfered with the printing and cutting operations of the newspaper. Thus, removal of these half-circle shaped sections resulted in additional expenditures and complications and were not widely received.

The present invention relates to a rotary cutting apparatus and method for cutting such newspapers by simultaneously cutting and providing an outwardly extending projection on one edge of the newspaper and a similarly shaped void on the opposite edge of the newspaper thus avoiding the need for removal of any material while providing a unique continuous system for identifying sections of newspapers.

SUMMARY OF THE INVENTION

Rotary cutting apparatus for repeatedly cutting web printed sheet material with a printed repeat portion of finite length thereon which comprises a cutting cylinder adapted for rotation in a manner such that the web printed sheet material passes thereby, cutting means extending generally along at least a portion of the length of said cutting cylinder on the outer surface thereof for engagement with support means for cutting the sheet material when positioned therebetween, the cutting means being generally continuous along a major portion of the length thereof and having a minor portion which is discontinuous with said major portion so as to cut said sheet material whereby the sheet material on one side of the cutting line is provided with a projecting portion corresponding in configuration and dimension with said minor portion and the sheet material on the other side of said cutting line is provided with a void portion corresponding in configuration and dimension to said projecting portion. Preferably, at least one of the cutting means extends generally lengthwise of the cutting cylinder on one side and a second of the cutting means extends generally lengthwise of said cutting cylinder on the opposite side. Also, each cutting means is preferably a cutting blade having a protective cheekwood positioned adjacent each side thereof. Each cheekwood is biased radially outwardly of the cutting cylinder to a normal radial position at least corresponding to the outward radial edge of the corresponding cutting blade, and each minor portion has an arcuate configuration to thereby provide an arcuate shaped projection in material which is cut by said cutting blade.

The cutting cylinder is adapted to rotate adjacent a backup cylinder, and the backup cylinder includes means positioned to engagably support each cutting means on the rotary cutting cylinder when the rotary cutting cylinder rotates in a first direction. The backup cylinder rotates in the opposite direction whereby the printed sheet material passes therebetween for cutting. The support means on the backup cylinder for engagement with the cutting means comprises elongated strips of resilient material positioned on the surface of the backup cylinder and located to provide backup support for each cutting blade as the rotary cutting cylinder and the backup cylinder rotate. Further, the elongated strips of resilient material each comprises a strip of elastomeric material having a generally flat support surface adapted to be engaged by a cutting blade to provide support for the cutting blade when the printed sheet material passes therebetween for cutting.

The backup cylinder is preferably larger in diameter than the cutting cylinder and the backup cylinder includes at least three of the backup strips spaced equally along the circumference thereof. Also, the minor portion of said cutting means is arcuate, preferably semi-circular. However, the minor portion of the cutting means may be rectangular, triangular or square configuration.

A method is disclosed for cutting newspapers or the like from stacks of continuous printed sheet material comprising providing a cylinder adapted for rotation in a manner such that the printed sheet material passes thereby, the cylinder having cutting means extending generally along at least a portion of the length thereof on the outer surface thereof for periodic engagement with corresponding support means adjacent thereto for cutting the sheet material when positioned therebetween. The cutting means has a major portion generally continuous in length and a minor portion which is discontinuous with the major portion. The method comprises rotating the cutting cylinder in a manner to periodically engage the backup means, passing the sheet material between said cutting cylinder and said backup means whereby the sheet material is cut into sections of distinct width whenever the cutting means engages said backup means.

A newspaper for publication is also disclosed which comprises a plurality of sheet materials having printed matter thereon and being foldable at a location generally between the side edges thereof. The sheet materials have a projecting portion at a location on one edge and corresponding void portion on the opposite edge, the void portion corresponding in configuration and dimension to the projecting portion.

The projecting portion and the void portion is preferably semi-circular in configuration, but may be rectangular, square or triangular in configuration.

BRIEF DESCRIPTION OF THE DRAWINGS

Preferred embodiments of the invention are described hereinbelow with reference to the drawings wherein.

DESCRIPTION OF THE PREFERRED EMBODIMENTS

Figure 1:
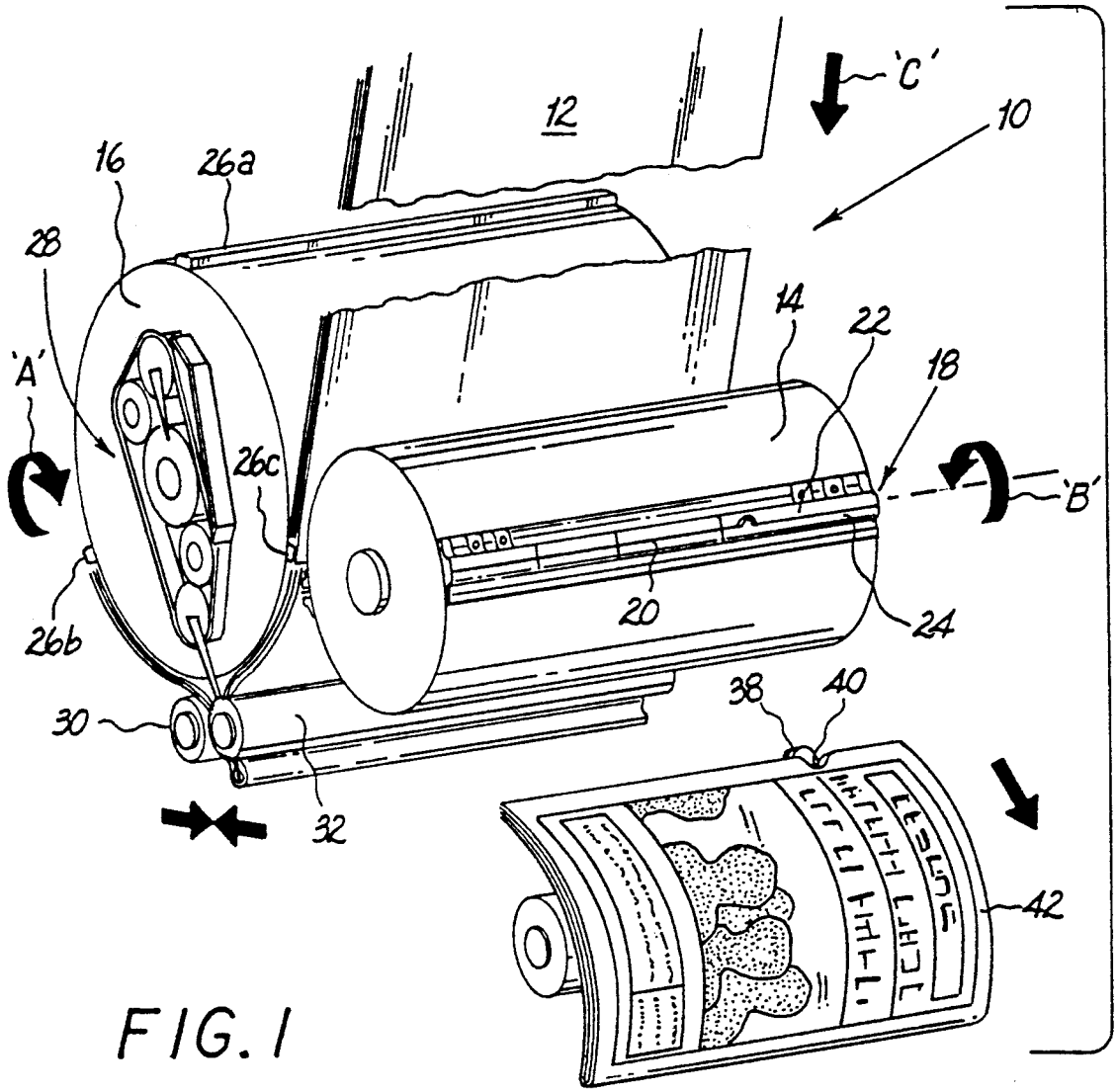
FIG. 1 is a perspective view of the rotary cutting apparatus constructed according to the invention illustrating the cutting device for cutting newspapers and providing an identification projection along one cut edge and a similar shaped void on the opposite edge.

Referring initially to FIG. 1 there is illustrated a perspective view of the rotary cutting apparatus 10 of the invention whereby continuous appropriately stacked printed material 12 is cut into individual newspapers for publication. It is significant to emphasize that although the present invention is directed to cutting newspapers generally of the tabloid-type, it is within the scope of the invention to apply the cutting apparatus and method of cutting disclosed herein to other periodicals or publications such as magazines, comic books, or the like, should the need arise.

Referring once again to FIG. 1 the printed material shown in this FIG. at 12 is comprised of a plurality of sheets of stacked newspaper material each of which have been imprinted with a series of identical printed matter according to a repeating pattern. After printing the sheets of stacked newspaper material in the manner shown, the cutting cylinder 14 shown in FIG. 1 is made ready for cutting and subsequent collating. Thus, when the entire stack of printed newspaper material is cut periodically by the cutting devices on the rotary cutting cylinder 14 as will be described, each cut is aligned with the beginning and the end of a particular newspaper unit such that by cutting the unit and folding the unit, the resultant folded unit will comprise a single newspaper. Thus, it will be clearly understood that whenever a cut is made through a stack of printed sheets as shown at 12 in FIG. 1, each cut will simultaneously define the left edge of one newspaper and the right edge of the next adjacent newspaper. As the material passes over the rotating cutting cylinder the next cut will respectively define the left edge of one newspaper and the right edge of the next adjacent newspaper.

Referring now once again to FIG. 1, the stacked sheets of paper having newspaper information imprinted thereon are shown at 12 and are passed downwardly in the direction of arrow "C" past cutting cylinder 14 which rotates in the counter clockwise direction as viewed from the left side and as shown by the arrow "B". The sheets are directed between cutting cylinder 14 and backup cylinder 16 which as shown, backup cylinder 16 rotates in the opposite direction as shown by arrow "A".

Cutting cylinder 14 includes a cutting system on each side (i.e. 180° apart) as shown generally at 18. The cutting system 18 is identical on both sides and is comprised essentially of a cutting blade 20 surrounded by appropriately spring loaded cheekwoods shown at 22 and 24. The cheekwoods surround the cutting blade 20 and are spring biased radially outwardly of the cylinder to a radial position which protects the cutting edge of the blade 20. Thus, the cutting edge is functional as a cutting device when the cheekwoods are pressed inwardly against the bias force of the springs (not shown) so as to permit the cutting blade 20 to be exposed. The cutting system is such that the backup cylinder 16 includes three backup strips **26*a*, 26*b* and 26*c* which are engaged by, and support the cutting blade 20 when the printed material is positioned therebetween so as to provide a backup support for the cutting blade 20 when the blade cuts the printed sheets. Backup strips 26*a*, 26*b* and 26*c*** are fabricated of a resilient elastomeric material to provide a cushioned backing for the cutting blade. Natural or synthetic rubber or a resilient plastic material may be used.

As the cutting cylinder 14 rotates, the cutter 20, which is located at the rear side of the cylinder as shown, periodically engages backup support strips 26 thereby cutting one edge of the newspaper as shown. Continued rotation of each of the cutting cylinders through a 180° arc corresponds to movement of the printed material 12 equal to the entire width of the tabloid newspaper and rotation of backup cylinder through a 120° arc. Thus, for each full rotation of the backup cylinder 16 and 1½ full rotations of cutting cylinder 14, at least three individual tabloid newspapers will be cut from the stack of printed sheets. Thus the outer circumference of the cutting cylinder 14 at the cutting edges of cutting blades 20 is approximately equal to twice the width of the tabloid newspaper being cut. Similarly the outer circumference of the backup cylinder is approximately equal to three times the width of the tabloid newspaper being cut.

Figure 2:
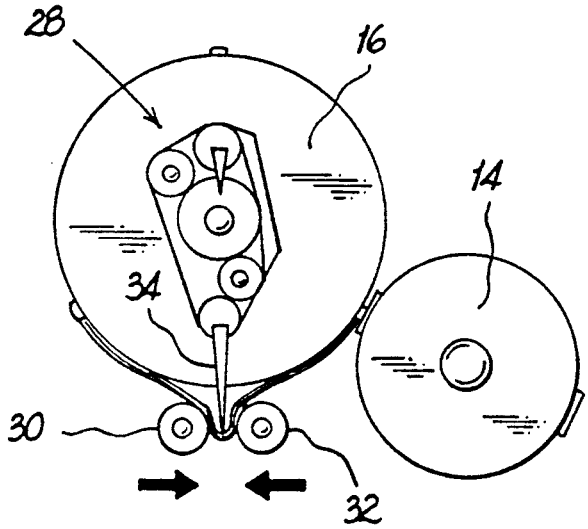
FIG. 2 is a side elevational view of the apparatus shown in FIG. 1.

Referring now to FIG. 2 there is shown a left side view of the cutting and backup cylinders of FIG. 1. A system 28 of gears and pusher devices are shown schematically whereby the cut newspaper extends past a pair of nip rollers 30 and 32 as the rollers rotate as described hereinabove. When the mid-fold portion reaches pusher 34 the system 28 activates the pusher 34 downwardly in a known manner to direct the tabloid newspaper into the nip of rollers 30, 32 where it is directed toward a stacking and wrapping area.

Figure 3:
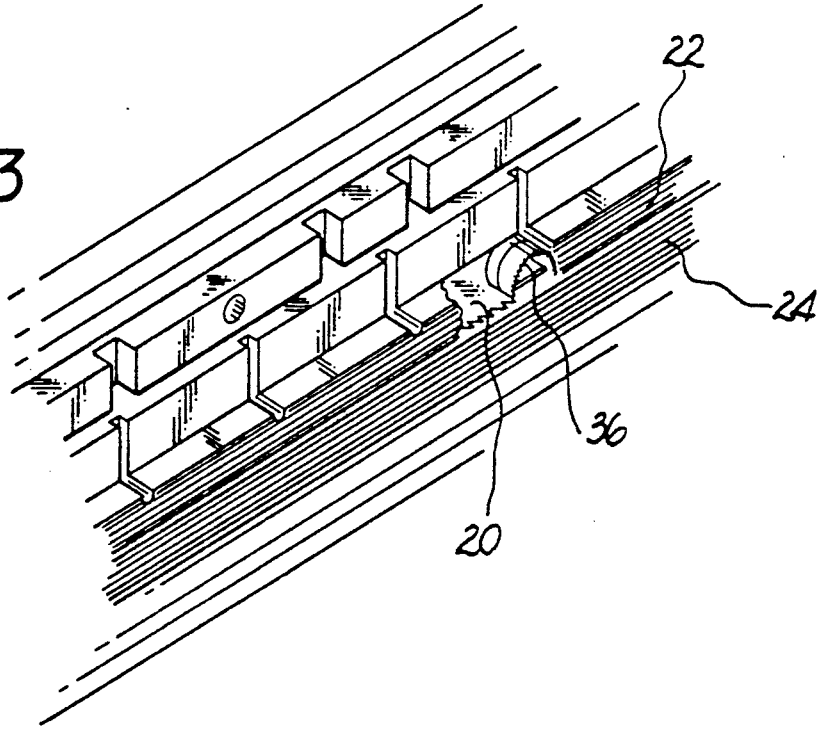
FIG. 3 is a perspective view of the cutting device of the cutting cylinder of the apparatus of FIG. 1, greatly enlarged to illustrate the configuration of the cutting device which forms part of the invention.
Figure 4:
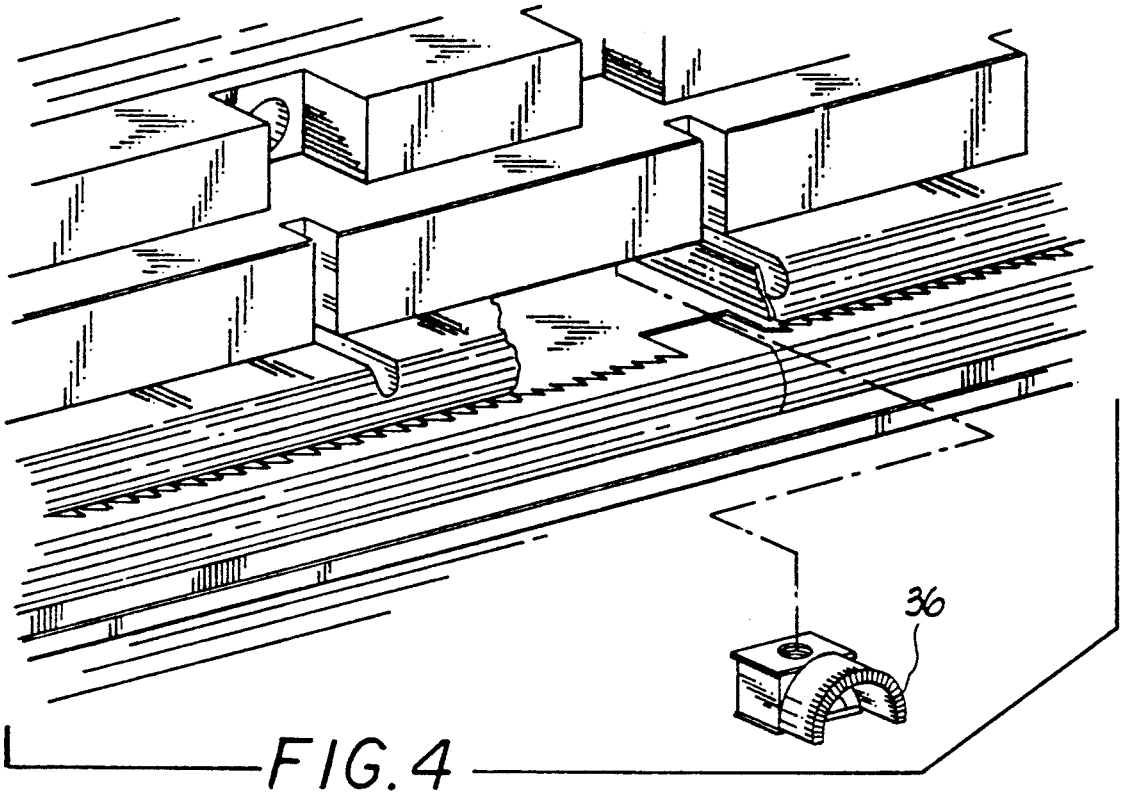
FIG. 4 is a greatly enlarged perspective view illustrating the arcuate portion of the cutting device of the invention whereby newspapers are cut in a manner to provide an identification projection on one edge and a corresponding void on the opposite edge.
Figure 5:
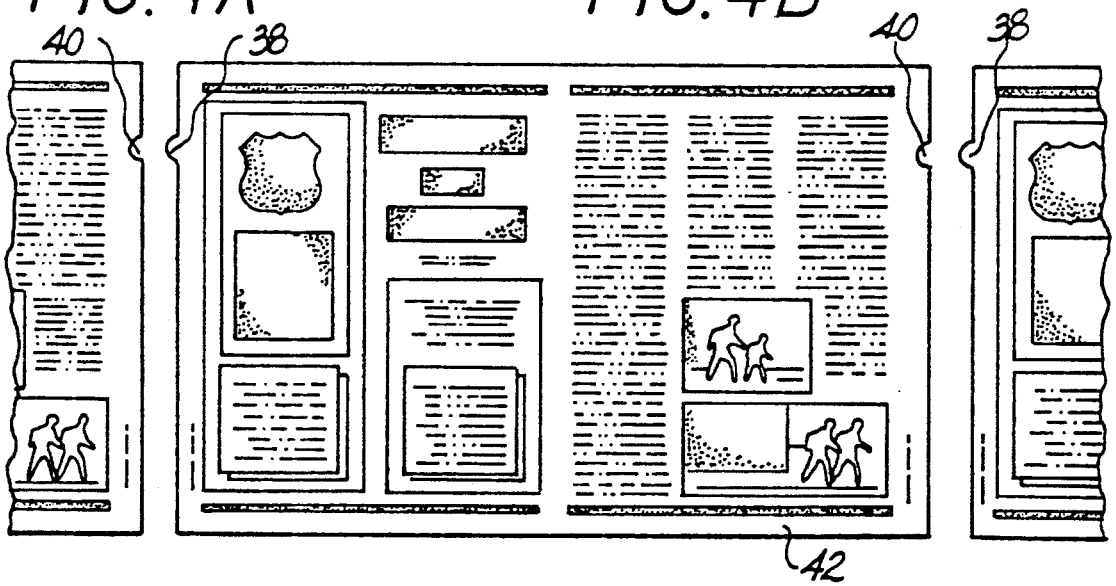
FIG. 5 is a plan view of a final tabloid-type newspaper product which has been cut on the rotary cutting apparatus of the invention illustrating the provision of an identification projection and a corresponding indentation on the respective opposite edges thus cut.

Referring now to FIGS. 3 and 4, a significant inventive feature of the present invention is illustrated. The major portion of the cutting blade 20 is straight as shown. The cutting blade 20 is uniquely provided with a minor portion in the form of arcuate shaped section 36 which essentially interrupts the generally and substantially straight configuration of the cutting blade 20. This arcuate section 36 may be alternatively shaped according to various configurations and is primarily provided to alter the shape of the edge of the newspaper so as to provide an outwardly extending arcuate projection 38 which is located on one side of the newspaper and is identical in shape to the shape of the arcuate section 36 of the cutting blade 20. Correspondingly, the arcuate cutting portion 36 will simultaneously provide an indentation or void 40 in the opposite edge of the next adjacent newspaper. Thus each newspaper will have a projection on one edge and a corresponding void on the other edge as shown in the tabloid newspapers in FIG. 5.

The provision of such projection 38 uniquely provides means for identifying a particular section of the newspaper when the section is selected to be cut on an apparatus constructed according to the present invention. Thus, it is conceivable that certain sections of the newspaper may be cut on a rotary cutting cylinder which has a conventional straight cutting blade incorporated therein, whereas a particular section of the newspaper which may be intended to be provided with a projection for identification purposes may be cut on an apparatus constructed according to the present invention. Similarly, other sections can be cut so as to be distinct from each other by repositioning the arcuate cutting section 36 of the cutting blade 20 to a different location along the cutting blade. Such repositioning can be readily accomplished because the cutting blade 20 is generally comprised of a plurality of small sections positioned adjacent one another. The arcuate cutting section 36 is generally formed of one of such smaller sections which can be readily interchanged with another straight section. In such instance, the resultant newspapers will have similar projections 38 and voids 40 at another location along the cut edge.

As noted hereinabove one example of such an application of the present invention would be to provide such a tab on a section such as the sports section (or other section) which is often inserted and separated from the remaining portion of a newspaper. In particular, since weekend or Sunday issues of newspapers are generally larger in size and scope, such issues are appropriate for application of the invention. The provision of the projection and oppositely shaped void will make the particular section or sections readily identifiable and separable by the consumer from the remaining portion of the second newspaper, thus making it simple to separate by the consumer from the remaining portion of the weekend newspaper.

Figure 4A:
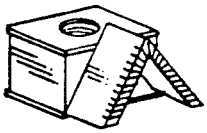
FIG. 4A is a perspective view of an alternative minor cutting blade of the present invention.
Figure 4B:
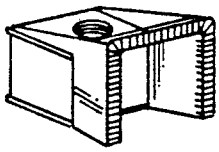
FIG. 4B is a perspective view of another alternative minor cutting blade of the present invention.

Although in the preferred embodiment of the apparatus of the present invention as shown and described herein incorporates an arcuate or half circular cutting section 36 to provide a similarly shaped half circular projection 38 on the tabloid newspaper 42, the cutting portion 36 can be alternatively configured in any desired manner provided that a discontinuity is provided in the cut formed by cutting blade 20. Consequently, it is clearly considered within the scope of the present invention to provide a cutting portion 36 of blade 20 in any number of alternative shapes including rectangular, triangular, square or other configurations, see for example, FIGS. 4A and 4B. In fact, combinations of different shapes may be used for separate sections of the same newspaper. Furthermore, more than two cutting blades may be utilized in one cylinder 16 to accommodate different size newspapers or publications.

As noted hereinabove, the provision of the discontinuous cutting portion 36 in cutting blade 20 is particularly adaptable to the method of cutting newspapers or other periodicals whereby a single cut in the printed material simultaneously provides the leading edge of one newspaper unit and the opposite edge of the next adjacent newspaper unit. Thus, the identification tab 38 is uniquely provided on the tabloid newspaper in a manner whereby the corresponding and similarly shaped void 40 is provided on the opposite edge, all without the need to collect and remove extraneous material.

Figure 6:
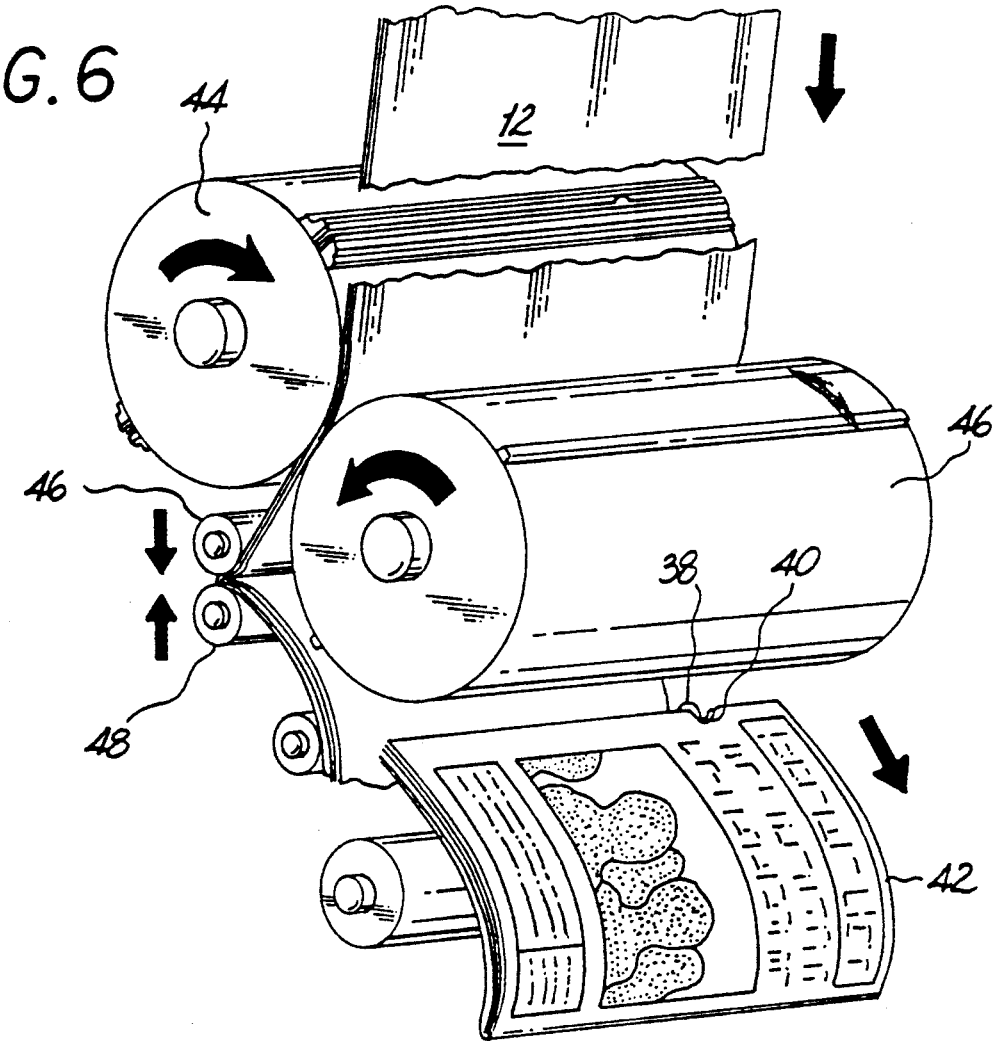
FIG. 6 is a perspective view of an alternative embodiment of the invention illustrating a cutting cylinder and a backup cylinder of approximately the same size.

Referring to FIG. 6, there is illustrated a perspective view of an alternative embodiment of the invention whereby the positions of the cutting cylinder 44 and the backup cylinder 46 are reversed and both are of approximately the same diameter. In the system shown in the FIG., application to tabloid newspapers will produce two newspapers 42 for each full rotation of the cutting and backup cylinders. Such newspapers are directed into the nip of rollers 46,48 as shown.

As noted, the present invention particularly contemplates the provision of an arcuate projection along one side edge of a tabloid newspaper, with a corresponding void on the opposite edge. However, the invention may also be adapted to other publications including newspapers other than tabloid-type newspapers. In such instances, however, the location of the projection must be appropriately selected in dependence upon the orientation of the printed newspapers as they leave the collating equipment and enter the cutting and collating equipment.

What is claimed is:

1. A method for cutting newspapers or the like from stacks of continuous printed sheet material comprising providing a cutting cylinder adapted for rotation in a manner such that the printed sheet material passes thereby, said cylinder having at least one cutting means extending generally along as least a portion of the length thereof on the outer surface thereof for periodic cooperation with corresponding support means adjacent thereto for cutting the sheet material when positioned therebetween, said at least one cutting means having at least one generally linear cutting blade supported on said cutting cylinder and defining at least one void along a cutting edge thereof and having at least one generally non-linear cutting blade independently supported on said cutting cylinder and complementary to said void to form a continuous cutting edge with the cutting edge of said at least one generally linear cutting blade, rotating said cutting cylinder a manner to periodically cooperate with said backup means, passing said sheet material between said cutting cylinder and said backup means whereby said sheet material is cut into sections of distinct width whenever said cutting means cooperates with said backup means.

2. A method for cutting newspapers or the like from stacks of continuous printed sheet material according to claim 1 wherein said at least one minor cutting blade of said at least one cutting means has a triangular configuration.

3. A method for cutting newspapers or the like from stacks of continuous printed sheet material according to claim 1 wherein said at least one minor cutting blade of said at least one cutting means has a square configuration.

4. A method for cutting newspapers or the like from stacks of continuous printed sheet material according to claim 1 wherein said at least one minor cutting blade of said at least one cutting means has a semi-circular configuration.

5. A method for cutting newspapers or the like from stacks of continuous printed sheet material comprising providing a cutting cylinder adapted for rotation in a manner such that the printed sheet material passes thereby, said cylinder having at least one cutting means extending generally along at least a portion of the length thereof on the outer surface thereof for periodic cooperation with corresponding support means adjacent thereto for cutting the sheet material when positioned therebetween, said at least one cutting means having at least one generally linear cutting blade supported on said cutting cylinder and defining at least one void along a cutting edge thereof and having at least one generally arcuate blade independently supported on said cutting cylinder and complementary to said void to form a continuous cutting edge with the cutting edge said at least one generally linear cutting blade, rotating said cutting cylinder in a manner to periodically cooperate with said backup means, passing said sheet material between said cutting cylinder and said backup means whereby said sheet material is cut into sections of distinct width whenever said cutting means cooperates with said backup means, each said cut is provided with a projecting portion corresponding in configuration and dimension with said at least one generally arcuate minor cutting blade and the sheet material on the other side of the cut is provided with a void portion corresponding in configuration and dimension with said projecting portion.

6. Rotary cutting apparatus for repeatedly cutting web printed sheet material with a printed repeat portion of finite length thereon which comprises a rotatable cutting cylinder adapted for rotation in a manner such that the web printed sheet material passes thereby, at least one cutting means extending generally along at least a portion of the length of said rotatable cutting cylinder on the outer surface thereof and positioned for cooperation with support means for cutting the sheet material when positioned therebetween, said cutting means including at least one generally linear cutting blade supported on said rotatable cutting cylinder and defining at least one void along a cutting edge thereof, and at least one generally non-linear minor cutting blade independently supported on said rotatable cutting cylinder and complementary to said at least one void, said cutting blades providing a continuous cutting edge to form a continuous cut in the sheet material whereby the sheet material on one side of the cut is provided with a projecting portion corresponding in configuration and dimension with said at least one generally non-linear minor cutting blade and the sheet material on the other side of the cut is provided with a void portion corresponding in configuration and dimension with said projecting portion.

7. Rotary cutting apparatus according to claim 6 wherein said rotatable cutting cylinder comprises a plurality of cutting means.

8. Rotary cutting apparatus according to claim 6 wherein each said cutting blade has a protective cheekwood positioned adjacent each side thereof.

9. Rotary cutting apparatus according to claim 8 herein each said cheekwood is biased radially outwardly of said rotatable cutting cylinder to a normal radial position at least corresponding to the outward radial edge of the corresponding cutting blade.

10. Rotary cutting apparatus according to claim 9 wherein said at least one minor cutting blade has an arcuate configuration to thereby provide an arcuate shaped projection in said web printed sheet material which is cut by said cutting blades.

11. Rotary cutting apparatus according to claim 10 wherein said rotatable cutting cylinder is adapted to rotate adjacent a backup cylinder, and said backup cylinder includes support means positioned to provide cooperative backup support for each said cutting means on said rotatable cutting cylinder when said rotatable cutting cylinder rotates in a first direction and said backup cylinder rotates in the opposite direction whereby said web printed sheet material passes therebetween for cutting.

12. Rotary cutting apparatus according to claim 11 wherein said cooperative backup support means on said backup cylinder for cooperatively supporting said at least one cutting means comprises elongated strips of resilient material positioned on the surface of said backup cylinder and located to provide backup support for each cutting blade as said rotatable cutting cylinder and said backup cylinder rotate.

13. Rotary cutting apparatus according to claim 12 wherein said elongated strips of resilient material each comprises a strip of elastomeric material having a generally flat support surface adapted to be engaged by said cutting blades to provide support for said cutting blades when said printed sheet material passes therebetween for cutting.

14. Rotary cutting apparatus according to claim 13 wherein said backup cylinder is greater in diameter than said rotatable cutting cylinder and said backup cylinder includes at least three of said backup strips spaced equally along the circumference thereof.

15. Rotary cutting apparatus according to claim 10 wherein said arcuate minor cutting blade is semi-circular.

16. Rotary cutting apparatus according to claim 6 wherein said at least one generally non-linear minor cutting blade of said at least one cutting means has an arcuate configuration.

17. Rotary cutting apparatus according to claim 6 wherein said at least one minor cutting blade of said at least one cutting means has a rectangular configuration.

18. Rotary cutting apparatus according to claim 6 wherein said at least one minor cutting blade of said at least one cutting means has a triangular configuration.

19. Rotary cutting apparatus according to claim 6 wherein said at least one minor cutting blade of said at least one cutting means has a square configuration.

20. Rotary cutting apparatus for repeatedly cutting stacked sheets of paper web material having newspaper imprinting thereon to form a plurality of distinct and successive cuts between identical and distinct printed portions on said sheet materials, which comprises a cutting cylinder adapted for rotation in a manner such that the stacks of printed sheet material pass thereby, two paper cutters extending generally along at least a portion of the length of said cylinder and supported on the outer surface thereof for periodic cooperation with a backup support cylinder for cutting the sheet material when positioned therebetween, each of said paper cutters including at least one generally linear major cutting blade defining at least one void along a cutting edge thereof and being supported on said cutting cylinder and at least one minor cutting blade independently supported on said cutting cylinder and complementary to said at least one void, said minor cutting blade being generally arcuately shaped so as to provide a continuous cutting edge with the cutting edge of said linear major cutting blade to form a continuous cut in the sheet material along a straight line except for a arcuate portion which is cut by said at least one minor arcuate cutting blade, the circumference of said cutting cylinder as defined by a radius extending to the cutting edge of said paper cutters being approximately equal to twice the width of the final newspaper to be cut whereby each complete rotation of said cutting cylinder will provide two individual newspapers.

21. Rotary cutting apparatus according to claim 20 whereby said backup cylinder has the same circumference of said cutting cylinder and contains at least two elongated strips of elastomeric backup material to provide cooperative backup support with each said paper cutters on said cutting cylinder such that rotation of said cutting cylinder in a first direction and rotation of said backup cylinder in the opposite direction causes said paper cutters to cooperate with said at least two elongated strips of elastomeric backup material so as to cut stacks of imprinted sheet material which pass therebetween.

* * * * *